US007223966B2

(12) United States Patent
Weiss et al.

(10) Patent No.: US 7,223,966 B2
(45) Date of Patent: May 29, 2007

(54) TIME-OF-FLIGHT MASS SPECTROMETERS WITH ORTHOGONAL ION INJECTION

(75) Inventors: Gerhard Weiss, Weyhe (DE); Carsten Stoermer, Bremen (DE); Oliver Räther, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 0 days.

(21) Appl. No.: 10/316,173

(22) Filed: Dec. 10, 2002

(65) Prior Publication Data

US 2003/0136903 A1 Jul. 24, 2003

(30) Foreign Application Priority Data

Dec. 18, 2001 (DE) ..... 101 62 267

(51) Int. Cl.
*H01J 49/40* (2006.01)

(52) U.S. Cl. ..... 250/287; 250/282; 250/285

(58) Field of Classification Search ..... 250/287
See application file for complete search history.

(56) References Cited

U.S. PATENT DOCUMENTS

| | | | | |
|---|---|---|---|---|
| 5,160,840 | A * | 11/1992 | Vestal | 250/287 |
| 5,654,544 | A | 8/1997 | Dresch | |
| 5,689,111 | A | 11/1997 | Dresch et al. | |
| 5,847,385 | A | 12/1998 | Dresch | |
| 6,013,913 | A * | 1/2000 | Hanson | 250/287 |
| 6,204,500 | B1 * | 3/2001 | Whitehouse et al. | 250/287 |
| 6,469,295 | B1 * | 10/2002 | Park | 250/282 |
| 6,518,569 | B1 * | 2/2003 | Zhang et al. | 250/287 |
| 2001/0011703 | A1 * | 8/2001 | Franzen | 250/287 |

FOREIGN PATENT DOCUMENTS

| | | | |
|---|---|---|---|
| DE | 100 05 698 | A1 | 2/2000 |
| JP | 2000-223065 | A | 8/2000 |
| JP | 2001-28253 | A | 1/2001 |
| JP | 2001-210267 | A | 8/2001 |
| WO | WO 99/01889 | A1 | 1/1999 |
| WO | WO 00/77823 | A2 | 12/2000 |

OTHER PUBLICATIONS

SIMION Application Note 52, p. 1, Scientific Instrument Services, presented at EAS 1996.*

* cited by examiner

*Primary Examiner*—Nikita Wells
*Assistant Examiner*—Phillip A Johnston
(74) *Attorney, Agent, or Firm*—The Law Offices of Paul E. Kurdirka

(57) ABSTRACT

The invention relates to time-of-flight mass spectrometers, equipped with ion reflector and ion detector, with orthogonal ion injection and outpulsing of a segment of the ion beam perpendicular to the direction of injection in a pulser. The invention is directed to a time-of-flight mass spectrometer in which a reflector and an ion detector each have an angular offset about an axis that is perpendicular to the respective directions of injection and deflection. This allows a large distance to be used between the pulser and detector with the highest possible utilization of ions.

7 Claims, 4 Drawing Sheets

TIME-OF-FLIGHT MASS SPECTROMETERS WITH ORTHOGONAL ION INJECTION

FIELD OF THE INVENTION

The invention relates to time-of-flight mass spectrometers, equipped with ion reflector and ion detector, with orthogonal ion injection and outpulsing of a segment of the ion beam perpendicular to the direction of injection in a pulser.

BACKGROUND OF THE INVENTION

If mass spectrometry has to measure the masses of large molecules, particularly those occurring in biochemistry, time-of-flight mass spectrometers are more suitable than other types of spectrometers because of the restricted mass ranges of other mass spectrometers. Time-of-flight mass spectrometers are often referred to by the abbreviation TOF or TOF-MS.

Two different types of time-of-flight mass spectrometer have developed. The first type comprises time-of-flight mass spectrometers for the measurement of ions generated in extremely short pulses in very small volumes of origin, for example by matrix assisted laser desorption (abbreviated to MALDI), a method of ionization appropriate for the ionization of large molecules.

The second type comprises time-of-flight mass spectrometers for the continuous injection of a primary beam of ions, a segment of which is then ejected in a "pulser" transverse to the primary beam direction into the time-of-flight mass spectrometer as a linearly extended bundle of ions. This generates a ribbon-shaped ion beam. This second type is referred to for short as an orthogonal time-of-flight mass spectrometer (OTOF); it is mainly applied in association with out-of-vacuum ionization by electrospray (ESI). The application of a very large number of pulses in a given time (up to 50,000 pulses per second) produces a large number of spectra, each based on a small number of ions, in order to exploit the ions in the continuous primary ion beam most effectively. Similar to MALDI, ESI is also suitable for the ionization of large molecules.

FIG. 1 shows a schematic diagram of a time-of-flight mass spectrometer with orthogonal ion injection according to prior art. A beam of ions of different initial energies and initial angles passes through an aperture (1) in an ion-guide system (4) and enters the ion-guide system (4) which is housed in a gas-tight casing. A damping gas is introduced into the ion-guide system along with the ion beam. The ions entering the chamber are decelerated by collision in the gas. Since there is a pseudo-potential for the ions in the ion-guide system which is at its lowest at the axis (5), the ions collect at the axis (5). The ions spread at the axis (5) to the end of the ion-guide system (4). The gas is pumped from the ion-guide system to the vacuum chamber (2) by the vacuum pump (6).

At the end of the ion guide system (4) there is a lens system (7), the second apertured diaphragm of which is integrated in the wall (8) between the vacuum chamber (2) for the ion-guide system (4) and the vacuum chamber (9) for the time-off-light mass spectrometer. In this case, the drawing lens system (7) consists of five apertured diaphragms. It draws the ions from the ion-guide system (4) to produce a fine primary ion beam with a small phase space volume which is focused into the pulser (12). The ion beam is injected into the pulser in the x direction. When the pulser is full of the ions of the preferred masses to be analyzed, in transit, a short voltage pulse propels a wide segment of the ion beam transverse to the previous flight direction in the y direction and forms a wide ion beam which is reflected in a reflector (13) and measured by an ion detector (14) with a high time resolution. In the ion detector (14), the ion signal, which is amplified by a secondary electron amplifier in the form of a double, multi-channel plate, is transmitted capacitively to a 50Ω cone. This signal, which has thus already been amplified, is passed to an amplifier via a 50Ω cable. The cable on the input end is terminated by the 50Ω cone so that no signal reflection can take place at this point.

In this prior art, the reflector (13) and detector (14) are oriented exactly parallel to the x direction of the ions injected into the pulser. The distance between the detector (14) and the pulser (12) determines the maximum level of utilization of ions from the fine ion beam.

In principle, the pulser has a very simple construction; the pulser region into which the parallel primary ion stream is injected in the x-direction is located between a pusher (or repeller) diaphragm and a puller diaphragm. The pusher does usually not have any apertures. The puller either has a grid or a fine slit through which the ions are ejected by pulsed acceleration in the y-direction.

The pusher and puller here only carry a small proportion of the entire acceleration voltage. One reason for this is that high voltages cannot be switched at high enough speeds. However, the main reason is that it is possible to time-focus ions of a single mass which are at different distances from the detector in the cross section of the fine primary ion beam when outpulsed (start location focusing according to Wiley and McLaren) because the field strength is adjustable. A compensation diaphragm is positioned after the puller and this suppresses penetration of the main acceleration field into the pulser region. Between the puller and the field-free drift region of the mass spectrometer, at least one additional diaphragm generates the main acceleration field, which provides the major proportion of the acceleration of the ions up to the drift region. The potential is held static on the diaphragms for the main acceleration field. The drift region usually has no field.

In the pulser, the ions are accelerated perpendicular to their x direction and leave the pulser through the slits in the slit diaphragms. The direction of acceleration is referred to as the y direction. However, after acceleration, the ions travel in a direction which lies between the y direction and the x direction since they retain their original velocity in the x direction undisturbedly. The angle to the y direction is $\alpha=\arctan\sqrt{(E_x/E_y)}$, where $E_x$ is the kinetic energy of the ions in the primary beam in the x direction and $E_y$ is the energy of the ions after acceleration in the y direction.

In commercially manufactured devices, the interior of the pulser has always been separated from the static electrical field of the main acceleration region by a grid. This means that the ions are pulsed out through the grid. Penetration of the main acceleration field through the grid during the filling phase is relatively slight, and can be controlled. In the literature, however, pulsers with slit diaphragms are also described.

The ions leaving the pulser now form a broad ribbon where ions of the same type and mass are located in a front in each case, the front being as wide as the ejected beam segment in the pulser. Light ions travel faster and heavy ions travel slower, but all travel predominantly in the same direction apart from small differences in direction arising from the slightly different kinetic energies $E_x$ of the ions when injected into the pulser. The field-free flight path must be completely surrounded by the acceleration potential so that the flight of the ions is not subject to interference.

According to Wiley and McLaren, ions of the same mass which are at different places in the cross section of the beam and therefore have different distances to travel to reach the detector can be time-focused in relation to their different start locations. This can be achieved by the following method: when the outpulse voltage is switched on, the field in the pulser is selected in such a way that the ions furthest away acquire a somewhat higher acceleration energy. This enables them to catch up again with the ions which were ahead at a "start location focal point". The position of the start location focal point can be chosen at will by adjusting the outpulse field strength in the pulser.

In order to achieve high resolution, the mass spectrometer is fitted with an energy-focusing reflector. This reflects the outpulsed ion beam in its entire width toward the ion detector, and provides an accurate time focus at the wide-surface detector for ions of the same mass but with slightly different initial kinetic energies in the y direction.

In prior technology, the reflector is always set up so that the plane of entry runs parallel to the x direction, i.e., parallel to the original direction of the fine ion beam injected into the pulser, as shown in FIG. 1. Ions of the same mass, which form a front in the newly formed ion beam, then enter the reflector at the same time, stop at the same time and are accelerated back in the same way and leave the reflector again at the same time. In the homogeneous reflection field, the ion paths have the form of flight parabolas. (In FIG. 1, the parabolas are approximated by triangles).

The ions travel from the reflector to a detector, which must be as wide as the ion beam in order for all the ions arriving to be measured. The detector must also be aligned exactly parallel to the x direction, as shown in FIG. 1, in order for all the ions of the same mass to be detected simultaneously.

A continuous stream of ions in the form of a fine primary ion beam is injected into the pulser in the x direction. The pulser begins to fill immediately after the ions of the last outpulsing cycle have left the pulser. After perpendicular ejection, the velocity of the ions in the x direction remains unaltered, in spite of the deflection perpendicular to the x direction. After lateral acceleration in the y direction and reflection in the reflector, the ions reach the detector in the same time they would have needed to reach this detector location by a straight, undeflected path (although they would then miss the detector since they would be flying parallel to the detector surface).

When the ions of highest mass have arrived at the detector, then not only is the pulser again filled with the heaviest ions but also the region between the pulser and the frontal side of the detector. However, it is only possible to analyze, in the next cycle, those ions which are in the detector at the time of the next outpulse. The ions in the region between the pulser and the detector are lost to the analysis. It is therefore apparent that the detector must be located as near to the pulser as possible for a high level of utilization of the ion beam. For a hundred percent utilization of the heavy ions, the pulser and the detector must touch each other (which is impossible for various physical reasons).

Considered more precisely, this applies only to the heaviest ions which are to be measured using this device. Only the heaviest ions determine the pulse rate to be used for the pulser as soon as it is full of the heaviest ions. A fraction of the lighter ions, which travel faster, have already left the pulser. Ions which only weigh a tenth of the heaviest ions travel faster by a factor of $\sqrt{10}\approx 3.16$. Only a third of them, at most, therefore remain in the pulser and only this third is outpulsed in the y direction.

However, problems arise from having a short distance between the pulser and the detector. On the one hand, the detector is a highly sensitive measuring device which responds to the switching in the pulser due to capacitative crosstalk which gives rise to spurious interference signals. The detector must be well screened from the pulser, and good screening requires space. On the other hand, the pulser needs to be longer than the ejected segment of ejected ions. Furthermore, in order to adjust the mass spectrometer, it is desirable to be able to measure the fine stream of ions—which is injected into the pulser when it is switched off hand travels through it to appear again at the other end—very precisely in a second detector. The second detector requires space. This measurement is therefore not possible if a short distance is required between the pulser and the detector.

If necessary, it is possible to place the pulser and the detector in different) planes. Because of the way it is designed with its 50Ω cone, the detector cannot be pushed nearer to the reflector since its cone will still end up lying next to the pulser. A position further away from the reflector involves making the mass spectrometer larger again, which is also undesirable.

SUMMARY OF THE INVENTION

The invention involves a time-of-flight mass spectrometer in which a reflector and detector are rotated about an axis which is perpendicular to the direction x of the primary ion beam and perpendicular to the direction y of outpulsing. This direction will be referred to as the z direction. FIG. 2 shows this arrangement. If the reflector is rotated by an angle β, then the detector must be rotated exactly by double this angle, i.e., 2β. The detector is also moved so that it picks up the ion beam again as it is reflected in the reflector. This relocation puts it at a considerable distance from the pulser. As a result, the crosstalk is reduced and the distance creates enough room for the detector to be well screened. As well as this, enough space is created for a second detector at the linear ejection aperture of the pulser. This detector is used to line up the injection of the ions with the pulser and, in particular, to optimize adjustment of the compensation voltage at the compensation diaphragm, which compensates for the acceleration field penetration into the pulser.

The invention is based on the fact that the energy focal lengths of the reflector are the same for all outpulsed ions even when the reflector is rotated, irrespective of the location of outpulsing and irrespective of the velocity of the ions in the pulser in the x direction. It is also based on the fact that the energy focal length of the reflector can be divided up at will into a partial focal length in front of the reflector and a partial focal length behind the reflector: the total focal length is constant (unlike an optical lens, where the sum of the reciprocals of the focal length of the object side and the image side of the lens are constant). All ions are therefore energy focused again in one focal plane by a reflector turned at an angle, although the focal lengths of the different ion beams are proportioned differently before and behind the reflector. The detector only needs to be adjusted exactly to the focal plane of the reflector.

In addition to this, the time focusing of ions which are located at different positions in the cross section of the fine ion beam, and therefore at different distances from the reflector, is not dependent on the rotation of the reflector.

Here, it should be noted that the division of the focal length into different partial focal lengths in front of and behind the reflector cannot be derived from previous time-of-flight mass spectrometers with point ion sources (such as MALDI ion sources). Rotation of the reflector has long been known for these time-of-flight mass spectrometers with point ion sources. However, unlike in this invention, the ions do not start from an extended line but they start just from a point. This simply involves the examination of a slightly divergent ion beam emanating from a point, as is produced only by a pair of ion beams. All mass spectrometers with orthogonal ion injection which have been introduced to the market so far have the parallel arrangement of a pulser, reflector and detector, as described above.

In the present invention, it may be desirable to use only a very small angle of rotation β of only approximately 2–5°. However, it is possible to use the entire range of angles from 1° to more than 45°. With a rotation of exactly 45° and a second reflector which is also rotated by 45°, it is possible to construct a very compact mass spectrometer with two reflectors.

DETAILED DESCRIPTION

Figure 1:
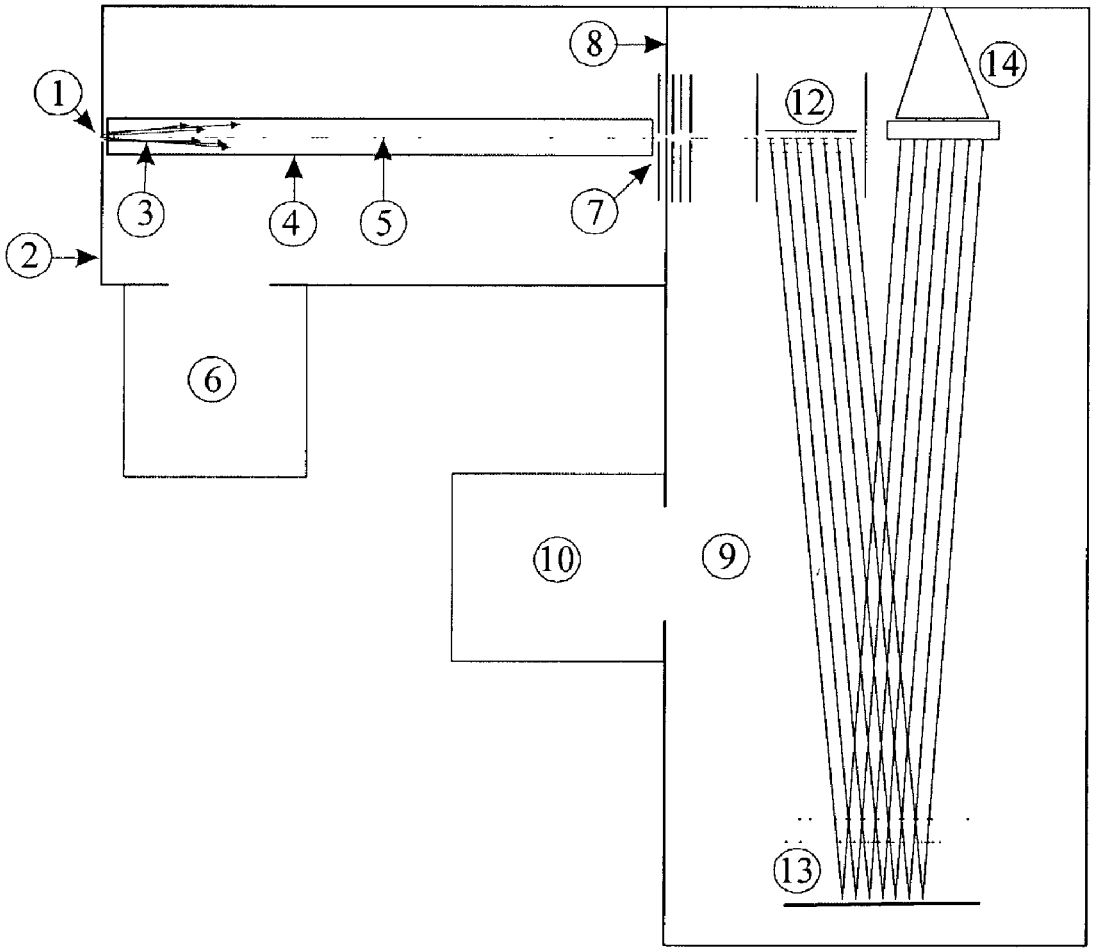
FIGURE 1 (PRIOR ART)
FIG. 1 is a schematic diagram of a time-of-flight mass spectrometer with orthogonal ion injection according to the prior art. The reflector (13) and detector (14) are oriented exactly parallel to the x direction of the ions injected into the pulser.
Figure 2:
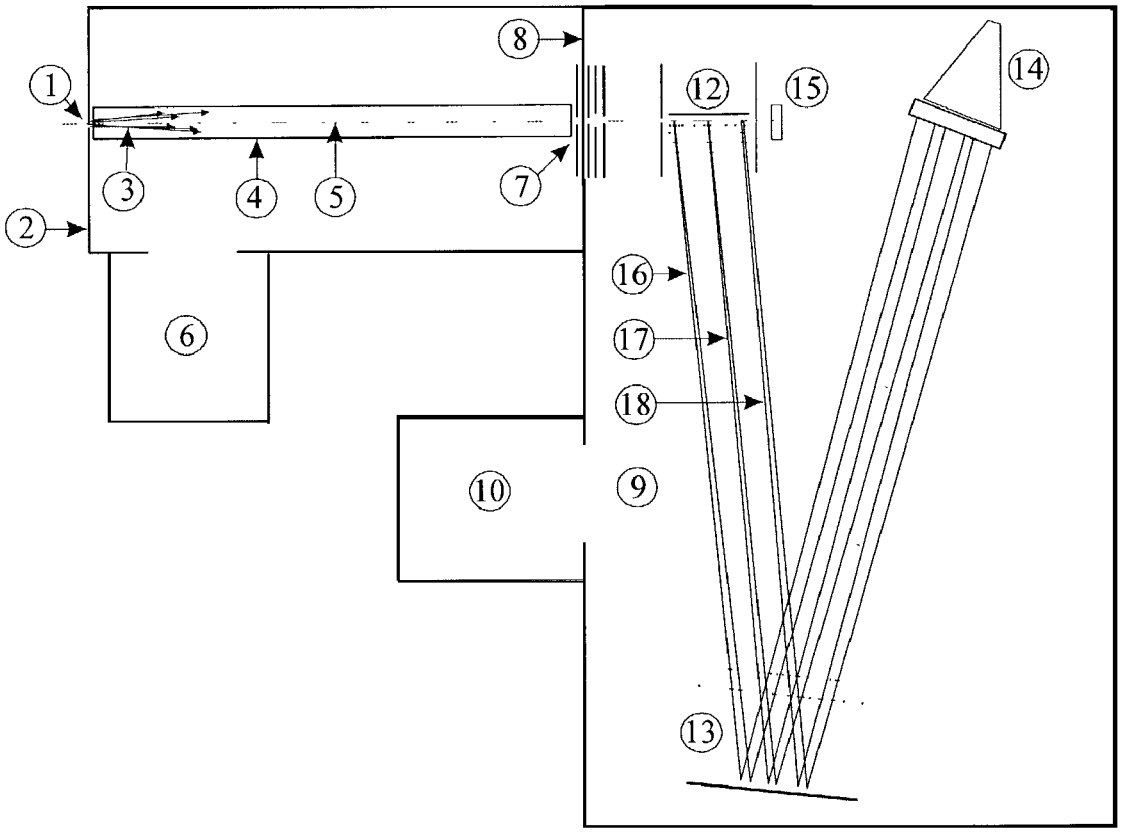
FIG. 2 shows an arrangement of a time-of-flight mass spectrometer according to the invention. The reflector (13) is rotated by an angle β about the z axis; the detector (14) is also rotated by an angle and is positioned so that it can pick up the ion beam coming from the reflector (13).

A first embodiment of the time-of-flight mass spectrometer is shown in FIG. 2. It can be seen that, compared to the prior art setup in FIG. 1, the reflector (13) and the detector (14) have been rotated and the detector (14) is now further away from the pulser (12). There is now enough space to shield the detector (14) well from outside interference (the shielding is not shown for reasons of clarity). There is even room for installing another detector (15) at the linear output of the pulser. In spite of the space which is gained, the level of utilization of the primary ion beam (5) can be improved. Both the reflector (13) and the detector (14) can be installed so that the angle can be adjusted to carry out fine adjustment using the mass resolution.

In FIG. 2, a fine primary ion beam (5) which defines the x direction is injected into the pulser at low energies between 20 and 30 electron volts. The fine ion beam can, for example, be generated from an electrospray ion source. In this case, the pulser consists of several electrodes which are partly used to produce the outpulsing, partly to compensate for the penetration of the acceleration field as the pulser is filled, and partly to further accelerate the ions to the reflector. The ion beam (5) consists of ions of low kinetic energy of approximately 20 to 30 electron volts which are injected into the region between a pusher and a puller through an aperture in the pulser (12); the ions therefore travel relatively slowly, the velocity being dependent on the masses. (To put it more precisely, the velocity is dependent on the ratio of the mass to the charge m/z, although, for the sake of simplicity, reference here is only made to the mass m). While the pulser is filling with ions, the first two electrodes are at the potential of the injected ion beam and maintain field-free operation in the pulse space, but this has to be protected against the penetration from the main acceleration field by a suitable voltage at a compensation aperture next to the puller electrode.

Three outpulsed beam pairs (16, 17 and 18) are shown in FIG. 2. Their ions have been outpulsed at different locations but injected into the pulser (12) in pairs of ions with slightly different velocities and therefore slightly different angles α (angle between the direction of flight and the y direction). By adjusting the focus correctly, all these ions are again precisely time-focused and energy-focused on the position of the detector. This arrangement pulls the pulser and detector spatially apart from each other without deteriorating the mass resolution or ion utilization. A second detector (15) can be attached to the end of the pulser in order to line up the injected beam and the penetration of the diaphragms precisely. In particular, the level of utilization (or the duty cycle) of the injected ions can even be increased.

If the reflector (13) is rotated by an angle β, then the detector (14) must be rotated exactly b double this angle, i.e., 2β. The detector (14) is also moved so that it picks up the ion beam again as it is reflected in the reflector (13). This relocation puts it at a considerable distance from the pulser (12). As a result, the crosstalk is reduced and the distance creates enough room for the detector (14) to be well screened (screening not shown in FIG. 2). As well as this, enough space is created for a second detector (15) at the linear ejection aperture of the pulser (12). This detector (15) is used to)line up the injection of the ions with the pulser and, in particular, to optimize adjustment of the compensation voltage at the compensation diaphragm, which compensates for the acceleration field penetration into the pulser.

Together with the acceleration energy of the outpulsing, the kinetic energy of approximately 20 to 30 electron volts per elementary charge of the ions determines the angle of deflection α. A change in the kinetic energy can be compensated for by changing the angle of the reflector and the detector. It is therefore possible to adjust to the optimal injection energy.

In particular, the angle β can be chosen so that the heaviest ions have reached the detector just when the pulser has been filled again. It is precisely at this point that the next outpulsing process takes place. None of the heavy ions are therefore lost.

For the light ions, dilution due to their higher velocity is inevitable for physical reasons. Losses of light ions must therefore be accepted. These losses can only be reduced if the injected ion beam only contains ions travelling at the same velocity (in spite of their having different masses). This type of injection can be produced by arrangements with travelling fields, but the quality of the beam, and therefore the mass resolution, must be expected to suffer. In addition, the detector must be much wider for this type of operation.

The field strength in the pulser is determined by the start location focusing conditions according to Wiley and McLaren, while the focal length to be adjusted up to the start location focus depends on the geometry of the time-of-flight spectrometer. All the other field strengths in the pulser, and therefore the potentials at the diaphragms, in turn all depend on the field strength in the pulser region.

The ions that have left the pulser now form a wide band, the ions of one type forming a front in each case. Light ions fly more rapidly, heavy ions more slowly, but all in the same direction. The field-free flight region must be entirely surrounded by the acceleration potential, so that the flight of the ions is not disturbed.

In this embodiment of the time-of-flight mass spectrometer according to the invention, the ions of same mass which are travelling in a front do not arrive at the input of the reflector simultaneously. They arrive one after the other, depending on the start location within the ejected segment of the ion beam, penetrate into the reflector one after the other, arrive at the deflection point in the reflector one after the other, are accelerated back one after the other, leave the reflector again one after the other and yet still meet the detector simultaneously as a front. The reason for this is that, for an energy-focusing ion reflector, the total energy focal length from the start location to the energy focus is always the same, irrespective of how the beam is divided up into one part before the reflector and one part after the reflector. It is only necessary for the part before the reflector and the part after the reflector to add up to the same total length and the flight path in the reflector to be the same length for all the ions.

The energy focusing is brought about by the ions of higher starting energy penetrating somewhat further into the reflector than the ions of lower starting energy and therefore having to travel a longer distance, which just compensates for their higher velocity, so that they arrive at the detector at the same time. The quality of the compensation is not dependent on when and where it enters the flight path.

Gridless reflectors with slits may be used, as can reflectors that are fitted with grids. There are single-stage reflectors which only possess one homogeneous reflection field, and two-stage reflectors which have a strong deceleration field upstream. If reflectors with grids are used it is favorable to use single-stage reflectors, since in that case it is only necessary for the ion beam to pass through a grid twice. A two-stage form is more advantageous for gridless reflectors, because this generates angular focusing in the z-direction, whereas a grid-less single-stage version always defocuses in the z-direction. Gridless reflectors, however, require unusually difficult adjustment. The energy focal length with the two-stage reflectors can be adjusted by means of the applied voltages; with the single-stage reflectors, the energy focal length is determined by the design (particularly by the length of the homogenous field).

Secondary electron multipliers in the form of double microchannel plates are usually used for the detector. The specialist in this field understands how to select from the available types in order to achieve the least possible temporal smearing of the mass signal. The ions are substituted by secondary electrons at the input of the multi-channel plate and these are multiplied in a known way in the channels by wall collisions which give rise to avalanches of more electrons. The emerging electron current, which is greatly amplified in comparison to the ion beam, is coupled capacitively to a 50Ω cone and passed on as free of interference as possible. The ion signals are only approximately 2–3 ns long and must not be time-smeared by the detector if the mass resolution is to be preserved. The specialist is familiar with the necessary technology.

By using the method of spatial focusing according to Wiley and McLaren, as described in the introduction, the spatial distribution of the ions transverse to the ion beam and beyond can be focused so that ions of the same mass also arrive at the detector simultaneously, in spite of the differences in the path length.

The focal length of this spatial focusing up to the start location focal point can to a large extent be freely chosen. It is nevertheless advantageous to locate this start location focus between the pulser exit and the reflector entrance, and to focus this start location focus on the detector by means of the energy-focusing reflector with reference to the energy of the particles. If, for instance, a single stage reflector is used, whose length determines its energy focusing length, then a relatively short length can be chosen for such a reflector by bringing the start location focus close to the reflector. A large distance to the start location focus also reduces the field strength in the pulser region. This means that the potentials that have to be switched are lower, which is favorable for the electronics.

Once the heaviest ions from the interesting range of masses have left the pulser, the electrodes are switched back to the filling phase potentials, and filling of the pulser from the continuously advancing primary beam begins again.

Due to the angle of rotation β of the reflector, it is now possible to optimize the level of utilization of the ions in the primary ion beam. This angle is selected so that the pulser has just been filled when the heaviest ions of the measurement range being analyzed have just arrived at the detector and been measured. The next section of the primary ion beam can then be outpulsed and no heavy ions are lost.

Figure 3:
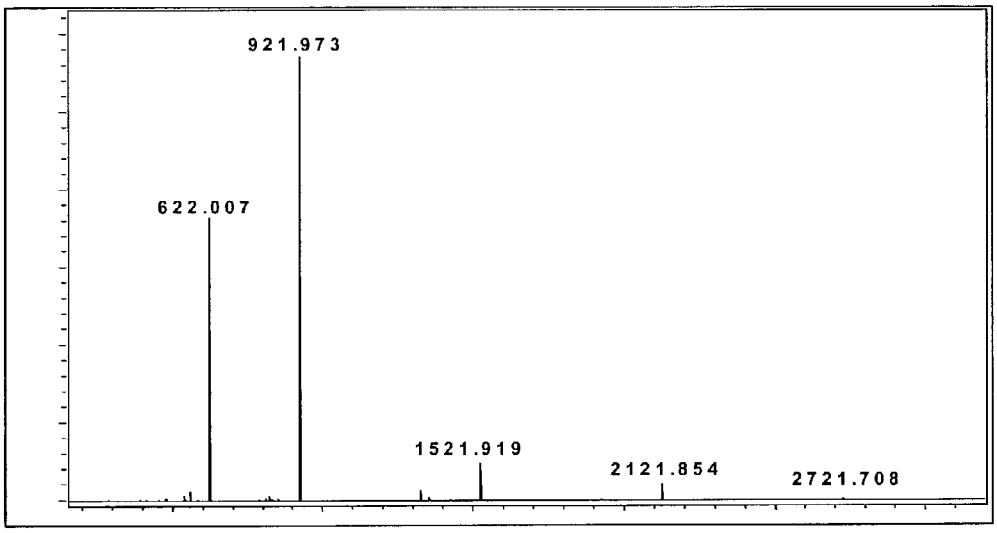
FIG. 3 shows a spectrum obtained by an orthogonal time-of-flight mass spectrometer which was operated according to this invention. The flight path from the pulser to the back of the reflector of the table top mass spectrometer version is only 55 cm.
Figure 4:
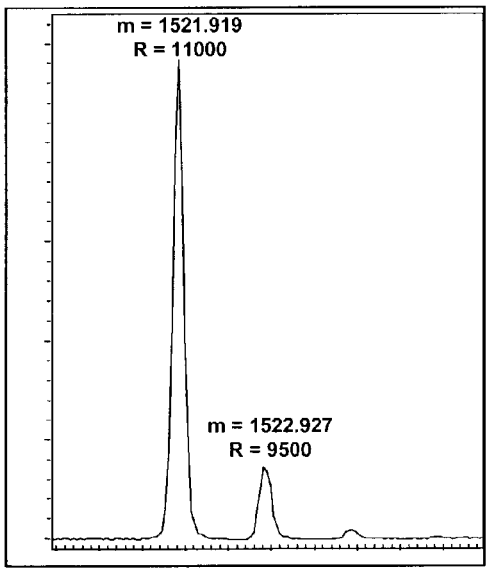
FIGS. 4 and 5 show enlarged regions of the FIG. 3 spectrum. The mass resolutions amount to $R=m/\Delta m=10,000$, where m represents the mass and Δm the width of the mass signals at half the height of the maximum. The temporal width of the mass signals is less than 3 ns.
Figure 5:
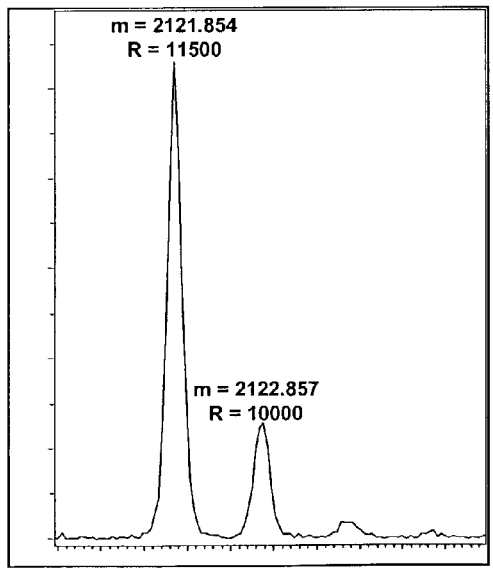

Although the invention can be substantiated mathematically, the practical application is more important and has been demonstrated experimentally, as shown in FIGS. 3 to 5. The arrangement shows a high mass resolution of approximately $R=m/\Delta m=10{,}000$ in a relatively small table top instrument with only 550 millimeter between the pulser and the back of the reflector. This resolution is approximately double that of larger time-of-flight mass spectrometers of this type which are currently available on the market. Although the resolution is also a consequence of other innovations, it is not disturbed by rotating the reflector and detector.

Figure 6:
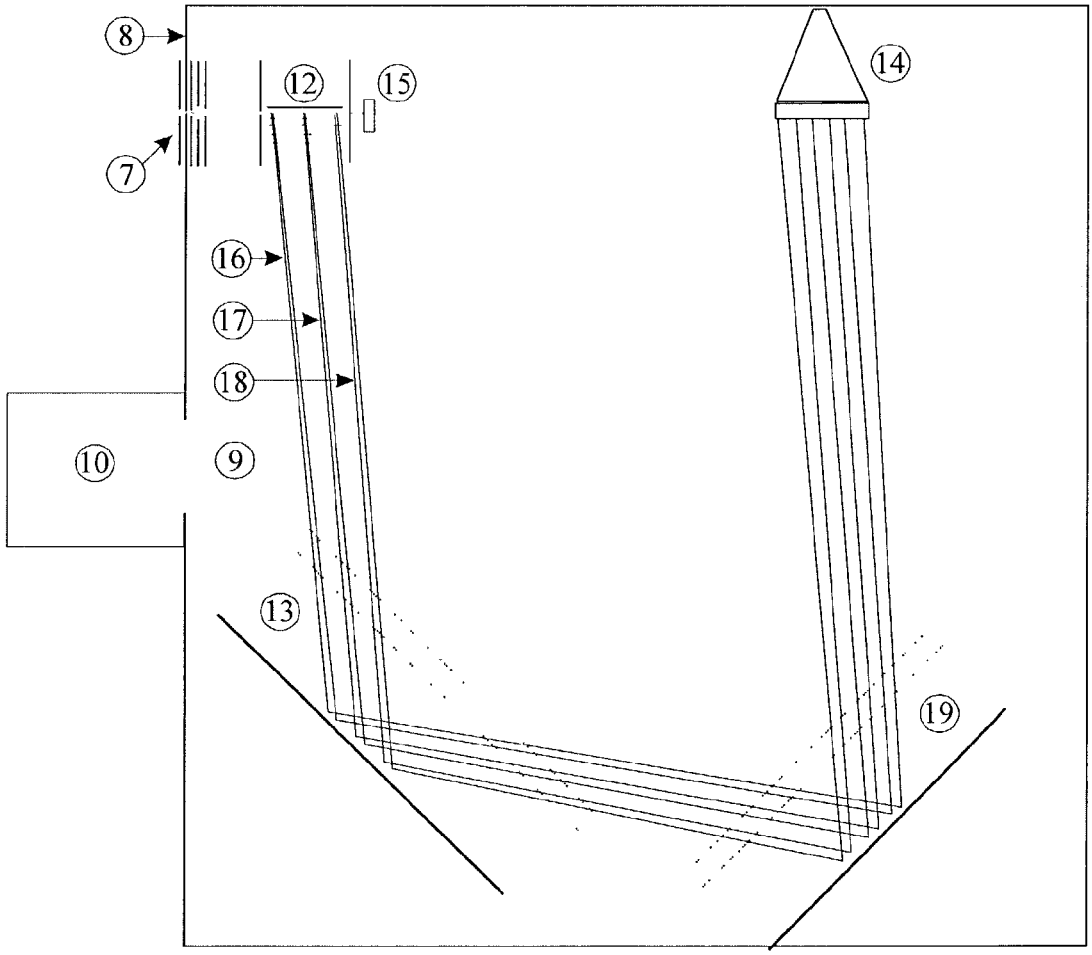
FIG. 6 shows a time-of-flight mass spectrometer with two deflections in two reflectors (13) and (19) rotated by 45°.

The angle of rotation chosen is usually not very large. During the course of our developments, angles between 2° and 5° have been used successfully. However, larger angles can definitely be used as shown in FIG. 6, which shows a space-saving mass spectrometer with two reflectors. The entire range of angles from approximately 1° to 45° is available, although the reflector has to be made very wide for an angle of nearly 45°.

FIG. 6 shows a time-of-flight mass spectrometer with two deflections in two reflectors (13) and (19) rotated by 45°. The front of the ions of the same mass travels between the pulser (12) and the first reflector (13) exactly parallel to the pulser. Between the first reflector (13) and the second reflector (19), the front of the ions of the same mass travels at right angles to the pulser (12) (vertically in the figure). Between the second reflector (19) and the detector (14) the front again travels parallel to the pulser (12). For this reason, the detector (14) must be oriented parallel to the pulser (12).

It is also possible to use two reflectors with smaller angles of rotation, where the detector is again moved nearer to the pulser than the one shown in FIG. 6. With even smaller angles of rotation, the ion beams in the mass spectrometer cross and the detector is placed on the other side of the pulser. With two angles of rotation of 22.5°, the ion beams cross at right angles and the detector surface is exactly perpendicular to the pulser. Very many different arrangements are possible.

Depending on the time of flight of the heaviest ions, the spectral scans can be repeated between 10,000 and 50,000 times per second. The spectra are added up over a specified recording time, such as 1 second. With such a large number of repetitions it is even possible to measure a type of ion, that only occurs once every hundredth or thousandth cycle of the pulser. It is, of course, also possible to exploit the rapid sequence of spectra in combination with a short recording time to measure the ions from rapidly changing processes, or from processes that separate substances precisely, such as capillary electrophoresis or micro-column liquid chromatography.

If the heaviest ions are not the main focus of interest but ions which are somewhat lighter, then the setup can also be optimized for these ions. The angle β is then adjusted so that the pulser has just been filled with these ions when the heaviest ions have arrived at the detector and the spectral scan is complete. The pulser in that case is not completely filled with the heaviest ions before they are outpulsed.

Using the essential features given in this invention it should be possible for any specialist in this field to develop time-of-flight mass spectrometers with both extremely high mass resolution and high utilization of ions and still maintain a reasonable distance between the pulser and detector. Because the size of the spectrometer and the details of the voltages used depend exclusively on the particular analytic task and other boundary conditions, precise dimensions of such spectrometers, i.e., flight lengths and other geometrical and electrical quantities, are not given here. The basic principles for selection of these details and the methods of mathematical treatment are, however, known to the specialist.

The invention claimed is:

1. A time-of-flight mass spectrometer comprising:

an ion pulser that outpulses a segment of a primary ion beam traveling initially in a first direction, the outpulsing being in a second direction substantially perpendicular to the first direction, such that the outpulsed ions travel as a group in a propagation direction having non-zero velocity components in the first direction and in the second direction, ions of identical masses forming respective ion fronts traveling in the propagation direction;

an ion reflector to which the outpulsed ions are directed, a plane of reflection of the reflector having a non-zero angular offset β relative to the first direction about an axis perpendicular to the first and second directions, ions at different positions along a common ion front arriving at the reflector at different times; and an ion detector to which the reflected ions are directed and which has an angular offset of exactly 2β relative to the first direction about an axis perpendicular to the first and second directions, such that all ions of a common ion front have the same energy focal length and arrive at the detector simultaneously.

2. A time-of-flight mass spectrometer according to claim 1 wherein β is between 1° and 45°.

3. A time-of-flight mass spectrometer according to claim 1 wherein the angular offset of the reflector is adjustable.

4. A time-of-flight mass spectrometer according to claim 1 wherein the angular offset of the detector is adjustable.

5. A time-of-flight mass spectrometer according to claim 1 wherein more than one reflector is used.

6. A time-of-flight mass spectrometer comprising:

an ion pulser that outpulses a segment of a primary ion beam traveling initially in a first direction, the outpulsing being in a second direction substantially perpendicular to the first direction;

an ion reflector to which the outpulsed ions are directed, a plane of reflection of the reflector having an angular offset β relative to the first direction about an axis perpendicular to the first and second directions, wherein the angular offset β is greater than 2° and smaller than 45°; and an ion detector to which the reflected ions are directed and which has an angular offset of exactly 2β relative to the first direction about an axis perpendicular to the first and second directions.

7. A method for adjusting an orthogonal time-of-flight spectrometer having a pulser that is filled with ions moving in a direction and then outpulses ions that have a range of masses from a lightest mass to a heaviest mass, the spectrometer further having a reflector that reflects the ions towards a detector, the method comprising:

(a) selecting a mass range;

(b) rotating the reflector around an axis perpendicular to the direction by an angular offset β relative to the direction that is selected so that ions having the heaviest mass arrive at the detector when the pulser is filled with ions in the selected mass range; and (c) rotating the detector by an angular offset of exactly 2β relative to the direction around an axis perpendicular to the direction.

* * * * *